US007665152B2

(12) United States Patent
Sloan et al.

(10) Patent No.: US 7,665,152 B2
(45) Date of Patent: Feb. 23, 2010

(54) DRAG HARNESS AND GARMENT COMBINATION

(75) Inventors: Douglas Sloan, Douglaston, NY (US); John J. Reilly, Rockville Centre, NY (US); Mary I. Grilliot, Dayton, OH (US); William L. Grilliot, Dayton, OH (US); Michael P. Harty, West Islip, NY (US); Francis T. Haskell, West Islip, NY (US); Thomas J. Fee, Hempstead, NY (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

(21) Appl. No.: 11/337,370

(22) Filed: Jan. 23, 2006

(65) Prior Publication Data

US 2007/0169246 A1 Jul. 26, 2007

(51) Int. Cl.
*A41D 13/00* (2006.01)

(52) U.S. Cl. ..... 2/69; 182/3

(58) Field of Classification Search ..... 2/69, 2/81, 94, 79, 227, 97, 69.5, 456, 305, 310; 182/3–7; 244/151 R, 143
See application file for complete search history.

(56) References Cited

U.S. PATENT DOCUMENTS 2,979,153 A * 4/1961 Hoagland et al. ..... 182/3
3,901,229 A * 8/1975 Hensel et al. ..... 128/873
4,177,877 A * 12/1979 Gallinati ..... 182/3
4,731,882 A * 3/1988 Ekman ..... 2/69
4,854,418 A 8/1989 Hengstenberger et al.
5,960,480 A * 10/1999 Neustater et al. ..... 2/456
5,970,517 A * 10/1999 Jordan ..... 2/69
6,006,968 A * 12/1999 McCarthy et al. ..... 224/184
6,205,584 B1 3/2001 Yocco
6,256,789 B1 * 7/2001 Young et al. ..... 2/69
6,490,733 B1 * 12/2002 Casaubon ..... 2/81
7,356,850 B2 * 4/2008 Turcotte et al. ..... 2/69
2005/0150846 A1 7/2005 Grilliot et al.
2005/0173188 A1 8/2005 Lewis et al.
2005/0211188 A1 9/2005 Grilliot et al.
2005/0284696 A1 12/2005 Grilliot et al.

* cited by examiner

*Primary Examiner*—Tejash Patel
(74) *Attorney, Agent, or Firm*—Wood, Phillips, Katz, Clark & Mortimer

(57) ABSTRACT

As combined with a protective garment having a generally tubular portion, such as a protective coat having a sleeve, or such as a pair of protective pants having a pants leg, which may be regarded as being generally tubular, and a drag harness, which is assembled to the generally tubular portion and which facilitates dragging a wear from a hazardous situation. The drag harness includes a loop, which is assembled to and within the generally tubular portion, and a grip, which extends through an aperture in the generally tubular portion. The loop and the grip may be made from a single length of strapping or, alternatively, the loop and the grip may be made from separate lengths of strapping. The loop may have a fixed length or, alternatively, the drag harness may have a running noose, by which the loop is adapted to tighten when the grip is pulled.

6 Claims, 2 Drawing Sheets

Fig. 4
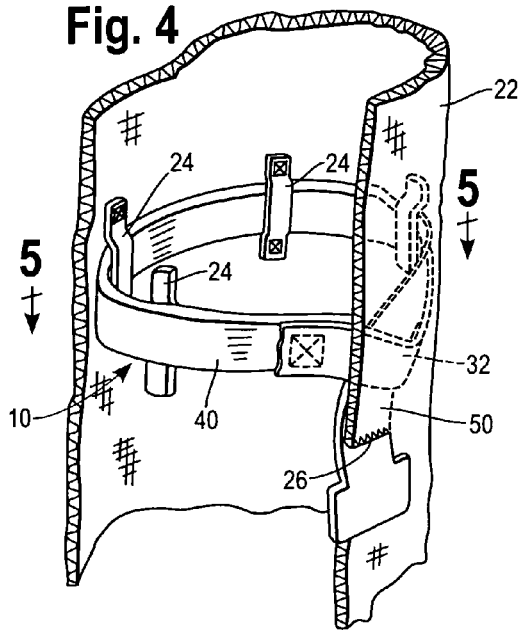
Fig. 5
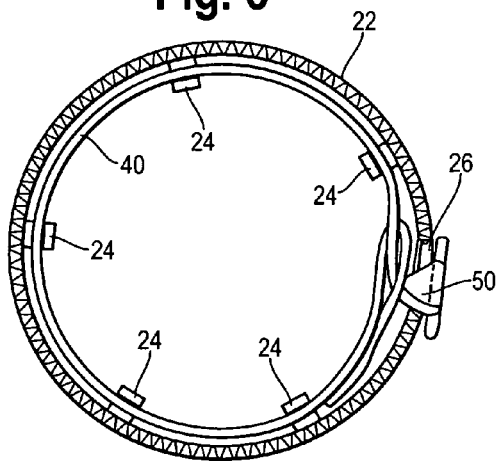
Fig. 6
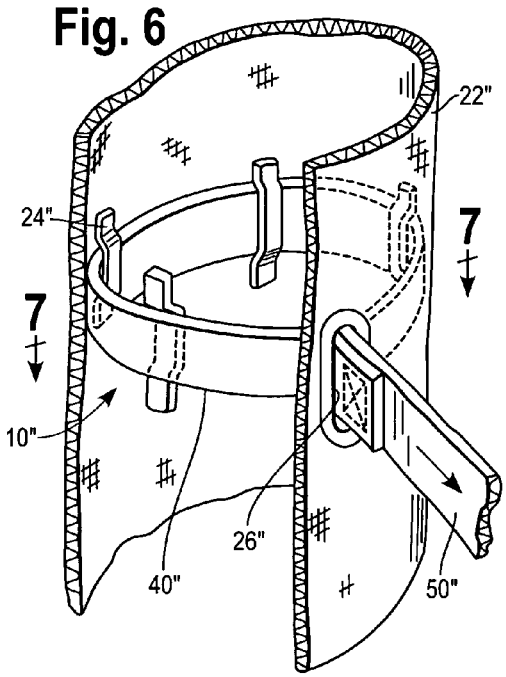
Fig. 7
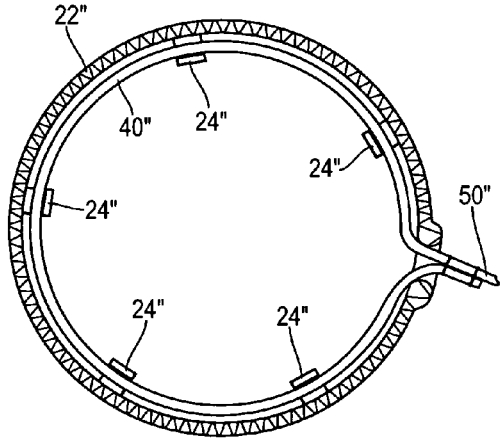
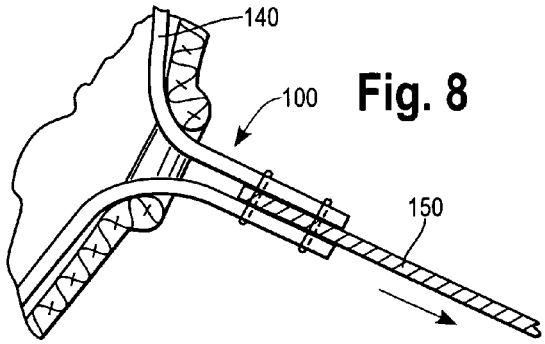
Fig. 8

DRAG HARNESS AND GARMENT COMBINATION

TECHNICAL FIELD OF THE INVENTION

This invention pertains generally to protective wear for a firefighter or for an emergency worker, and particularly to a protective garment and a drag harness, in a novel combination.

BACKGROUND OF THE INVENTION

As exemplified in prior patents including U.S. Pat. No. 4,682,671, U.S. Pat. No. 4,854,418, and U.S. Pat. No. 6,205,584 B1, and in prior published applications including U.S. Patent Application Publication No. US 2005/0173188 A1, U.S. Patent Application Publication No. US 2005/0211188 A1, and U.S. Patent Application Publication No. US 2005/0284696 A1, drag harnesses are known, which can be advantageously worn by firefighters and by emergency workers and which are attachable to upper portions of wearer's bodies, via their coats.

Moreover, as exemplified in U.S. Patent Application Publication No. US 2005/0150846 A1, a drag harness is known, which can be advantageously worn by a firefighter or by an emergency worker and which is attachable to an upper portion of a wearer's body, via an air tank of a self-contained breathing apparatus.

Drag harnesses, as discussed above, are used by rescuers to facilitate dragging wearers of such harnesses from hazardous situations.

SUMMARY OF THE INVENTION

This invention provides, in a novel combination for a firefighter or for an emergency worker, a protective garment having a generally tubular portion, such as a protective coat having a sleeve, which may be regarded as being generally tubular, or such as a pair of protective pants having a pants leg, which may be regarded as being generally tubular, and a drag harness, which is assembled to the generally tubular portion and which facilitates dragging a wear from a hazardous situation.

Preferably, the drag harness includes a loop, which is assembled to and within the generally tubular portion. Preferably, the drag harness also includes a grip, which extends through an aperture in the generally tubular portion. The loop and the grip may be made from a single length of strapping or, alternatively, the loop and the grip may be made from separate lengths of strapping. The loop may have a fixed length or, alternatively, the drag harness may have a running noose, by which the loop is adapted to tighten when the grip is pulled.

Advantageously, the drag harness may be one of two drag harnesses, which are similar and each of which is attached similarly to a different one of the generally tubular portions of the protective garment.

BRIEF DESCRIPTION OF THE DRAWINGS

In FIG. 2, as compared to FIG. 1 wherein the pair of protective pants appears in full lines, one pants leg of the pair of protective pants appears and one leg of the person being dragged appear in broken lines so that one of the drag harnesses in its entirety can appear in full lines.

FIG. 4 is a further enlarged, fragmentary detail, which illustrates how the drag harness of FIG. 2 is assembled to the pants leg of FIG. 2. FIG. 5 is a sectional view, which is taken along line 5-5 of FIG. 4, in a direction indicated by arrows.

FIG. 6 is an analogous, fragmentary detail, which illustrates how a drag harness, which is made differently, is attached similarly to and within a sleeve of a protective coat, in another possible embodiment of this invention. FIG. 7 is a sectional view, which is taken along line 7-7 of FIG. 6, in a direction indicated by arrows.

FIG. 8 is an analogous, fragmentary, sectional view, which illustrates a drag harness made differently but being useful similarly.

DETAILED DESCRIPTION OF THE ILLUSTRATED EMBODIMENT

Figure 1:
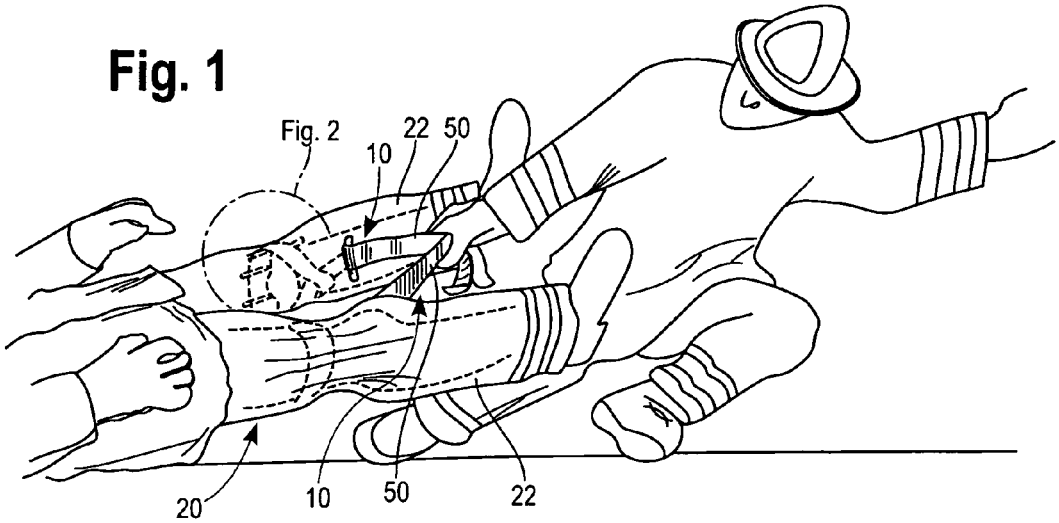
FIG. 1 is a fragmentary, pictorial view of a rescuer dragging a person from a hazardous situation, via two drag harnesses. As illustrated, the drag harnesses are similar to each other and are attached similarly to and within the pants legs of a pair of protective pants, in one contemplated embodiment of this invention.

As illustrated in FIG. 1, a rescuer is dragging, from a hazardous situation, a person wearing a novel combination of two drag harnesses 10 and a pair of protective pants 20 having two pants legs 22, each of which is adapted to cover one leg of the person wearing the protective pants 20. The drag harnesses 10 are similar to each other. The drag harnesses 10 are attached similarly to the pants legs 22 of the protective pants 20.

Figure 2:
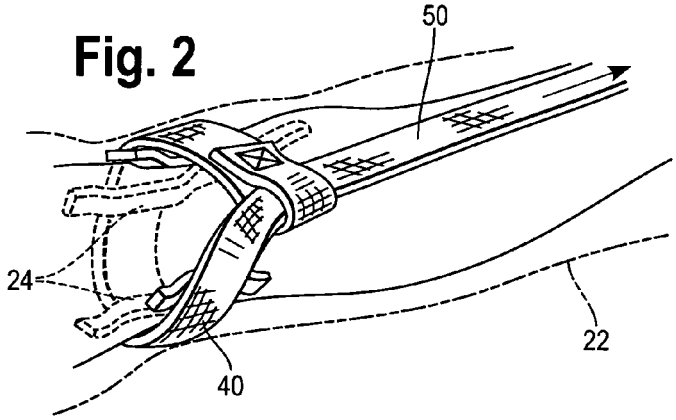
FIG. 2 is an enlarged, fragmentary detail, which is taken in a region indicated in FIG. 1.

As illustrated in FIGS. 2, 4, and 5,s each drag harness 10 comprises a single length of strapping 30, which is made of leather, nylon, p-aramid, m-aramid, or another suitable material. One end of the strapping length 30 is attached (by sewing, as illustrated, by riveting, or otherwise) to a near portion of the strapping length 30 so as to form a running noose 32, through which the other end of the strapping length 30 is passed, whereby to form a loop 40 and a grip 50 extending from the loop 40.

The loop 40 is assembled to and within one pants leg 22 of the protective pants 20, via a series of short straps 24, which are made from leather or from a suitable fabric, which are attached (by sewing, as illustrated, by riveting, or otherwise) to and within the pants leg 22, and which are spaced from one another around the pants leg 22. Preferably, if the leg portion 22 of the protective pants 20 has an outer shell and a liner or liners, the loop 40 is assembled to and within the outer shell. The grip 50 extending from the loop 40 passes through an aperture 26 of the pants leg 22, so as to extend outwardly from the pants leg 22. Preferably, the loop 40 is attached loosely, via the straps 24. Whether attached loosely or tightly, the loop 40 is adapted to tighten around the leg of the person wearing the novel combination, when the grip 50 is pulled.

Thus, a rescuer can grasp the grip 50 of each drag harness 10 or the grip 50 of one drag harness 10, if the grip 50 of the other harness 10 is unreachable, to facilitate dragging a person wearing the novel combination from a hazardous situation.

Figure 3:
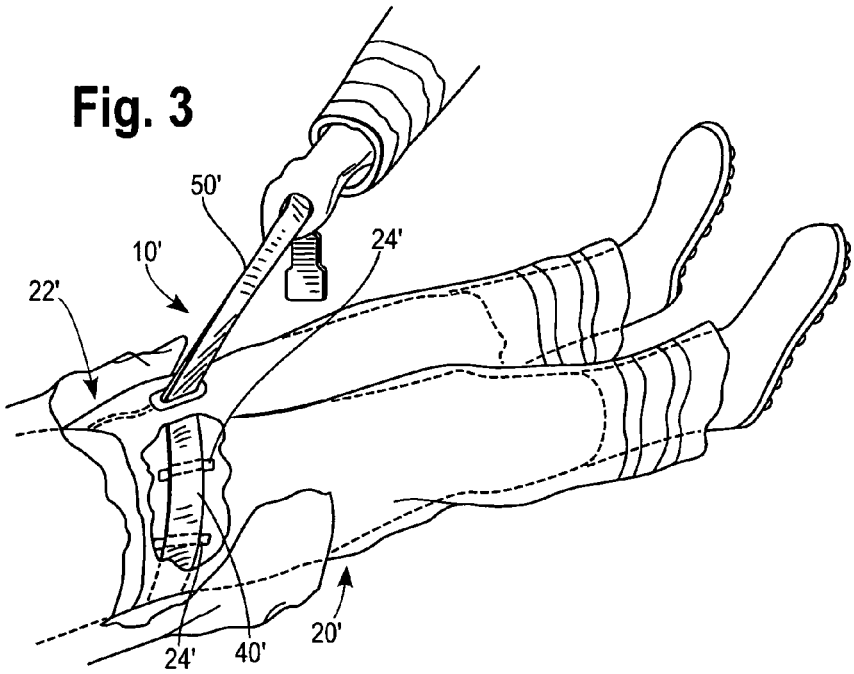
FIG. 3, which is analogous to FIG. 1, is fragmentary, pictorial view of a rescuer dragging a person from a hazardous situation, via one drag harnesses. The drag harness is similar to the drag harnesses of FIGS. 1 and 2, except that the drag harness may be somewhat longer, and the drag harness is assembled to and within the torso-covering portion of a pair of protective pants, in an alternative embodiment of this invention.

As illustrated in FIG. 3, a rescuer is dragging, from a hazardous situation, a person wearing a novel combination of one drag harness 10' and a pair of protective pants 20' having a torso-covering portion 22' between its waist and its crotch.

The drag harness 10' is similar to the drag harnesses 10, except that the drag harness 10' may be somewhat longer. The drag harness 10' has a loop 40', which is assembled to and within the torso-covering portion 22', near the waist, via a series of short straps 24', which are similar to the straps 24 and which are attached (by sewing, by riveting, or otherwise) to and within the torso-covering portion 22'. The drag harness 10' has a grip 50', which extends from the loop 40' and which passes through an aperture 26" in the torso-covering portion 22'.

As illustrated in FIGS. 6 and 7, a drag harness 10" is assembled to and within a sleeve 22" of a protective coat, which is not further illustrated, The drag harness 22" is made from a single length of strapping and is sewn so as to have a loop 40", which has a fixed length, and a grip 50", which extends from the loop 50". The loop 40" is assembled to and within the sleeve 22", via a series of short straps 24", which similar to the straps 24 and which are attached (by sewing, as illustrated, by riveting, or otherwise) to and within the sleeve 22". The grip 50" extending from the loop 40" passes through an aperture 26' in the sleeve 22".

As illustrated in FIG. 8, and of the drag harnesses described above can be replaced by a drag harness 100, which is made from two lengths of strapping. A first length of strapping is used for a loop 140 and may be made from a material, such as canvas, which is comfortable for a wearer. A second length of strapping is used for a grip 150, which is sewn to the ends of the loop 140, and may be made from a material, such as an aramid, which may be less comfortable for a wear but which is fire retardant.

In any of the disclosed embodiments, if the protective garment has, at the generally tubular portion, an outer shell and a lining system having a liner or liners, it is preferred for the drag harness to be attached, as disclosed herein, to and within the outer shell, between the outer shell and the lining system. Moreover, so as to avert fraying of the generally tubular portions, the apertures passing the grips of the drag harnesses may have bound margins or may be defined by grommets.

The invention claimed is:

1. For a firefighter or for an emergency worker, a combination comprising a protective garment, which has a generally tubular portion, and a drag harness, which is assembled to the generally tubular portion and which facilitates dragging a wearer from a hazardous situation, wherein the drag harness includes a grip and extends from an interior of the generally tubular portion to an exterior of the generally tubular portion through an aperture in the generally tubular portion and wherein the drag harness further includes a loop, which is assembled to and within the generally tubular portion, the loop and the grip being made from separate lengths of strapping.

2. For a firefighter or for an emergency worker, a combination comprising a protective garment, which has a generally tubular portion, and a drag harness, which is assembled to the generally tubular portion and which facilitates dragging a wearer from a hazardous situation, wherein the drag harness includes a grip and extends from an interior of the generally tubular portion to an exterior of the generally tubular portion through an aperture in the generally tubular portion and wherein the drag harness further includes a loop, which is assembled to and within the generally tubular portion, and a running noose, by which the loop is adapted to tighten around the limb of a wearer when the grip is pulled.

3. The combination of claim 2, wherein the protective garment is a protective coat and wherein the generally tubular portion is a sleeve of the protective coat.

4. The combination of claim 2, wherein the protective garment is a pair of protective pants and wherein the generally tubular portion is a pants leg of the pair of protective pants.

5. The combination of claim 2, wherein the protective garment is a pair of protective pants and wherein the generally tubular portion is a torso-covering portion of the pair of protective pants.

6. The combination of claim 2, wherein the generally tubular portion is one of two generally tubular portions of the protective garment, the generally tubular portions being similar, wherein the drag harness is one of two drag harnesses, the drag harnesses being similar, and wherein each of the drag harnesses is assembled to a respective one of the generally tubular portions.

* * * * *